US005190160A

United States Patent [19]

Murphy et al.

[11] Patent Number: 5,190,160

[45] Date of Patent: Mar. 2, 1993

[54] METHOD AND APPARATUS FOR ENHANCING TRANSPORT OF KNOTS IN A KNOT DRAINER

[75] Inventors: Patrick D. Murphy; Ian J. H. Clarke-Pounder, both of Nashua, N.H.; Brian J. Gallagher, Beaconsfield, Canada

[73] Assignee: Ingersoll-Rand Company, Woodcliff Lake, N.J.

[21] Appl. No.: 739,398

[22] Filed: Aug. 2, 1991

[51] Int. Cl.[5] ..... B07B 1/22

[52] U.S. Cl. ..... 209/270; 209/379; 209/397; 210/297; 210/298; 162/55; 162/251

[58] Field of Search ..... 209/250, 257, 263, 270, 209/273, 379, 380, 397; 210/297, 298, 304; 162/55, 251

[56] References Cited

U.S. PATENT DOCUMENTS

| | | | |
|---|---|---|---|
| 2,483,200 | 9/1949 | Haug | 209/270 X |
| 3,390,777 | 7/1968 | Grieselhuber | 210/297 |
| 4,202,759 | 5/1980 | Krolopp et al. | 209/270 X |
| 4,347,134 | 8/1982 | Svehaug | 210/298 X |
| 4,356,085 | 10/1982 | Schon et al. | 209/273 |
| 5,051,168 | 9/1991 | Hautala | 162/55 X |

FOREIGN PATENT DOCUMENTS

| | | | |
|---|---|---|---|
| 0607866 | 5/1978 | U.S.S.R. | 209/273 |
| 0889767 | 12/1981 | U.S.S.R. | 162/55 |

*Primary Examiner*—Joseph E. Valenza
*Assistant Examiner*—Tuan N. Nguyen
*Attorney, Agent, or Firm*—Robert F. Palermo

[57] ABSTRACT

A method and apparatus for enhancing knot transport in a knot drainer has a provision for decreasing tangential velocity of the feed slurry in the inlet chamber, a hydrodynamic force reduction provision in the screening chamber, and a provision for increasing the ratio of circumferential friction forces to axial friction forces in a housing extension above the screening chamber. This drastically reduces frequency of knot transport interruptions which would otherwise occur in the knot drainer, thereby improving knot drainer performance efficiency.

24 Claims, 4 Drawing Sheets

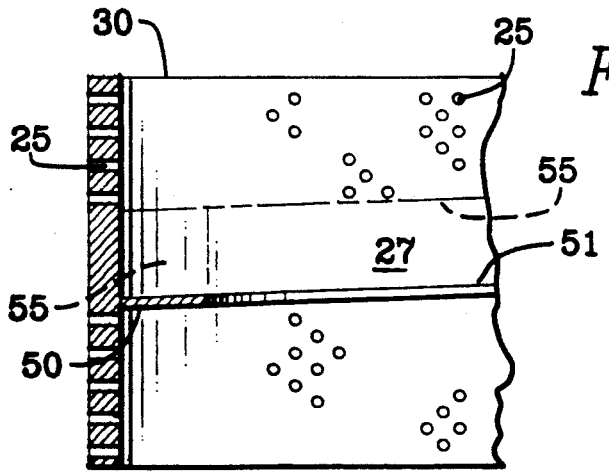
FIG. 5
FIG. 6
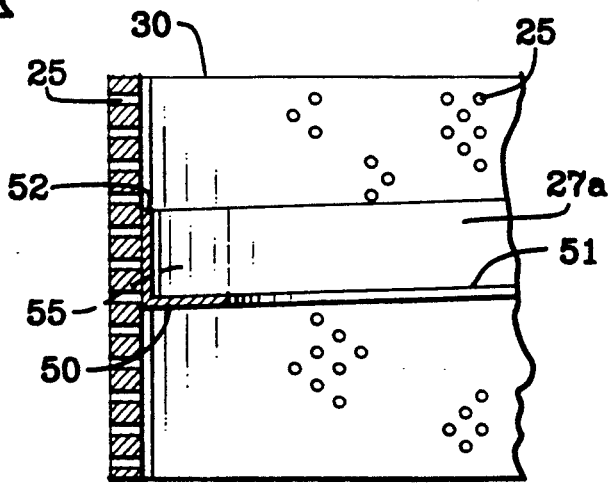
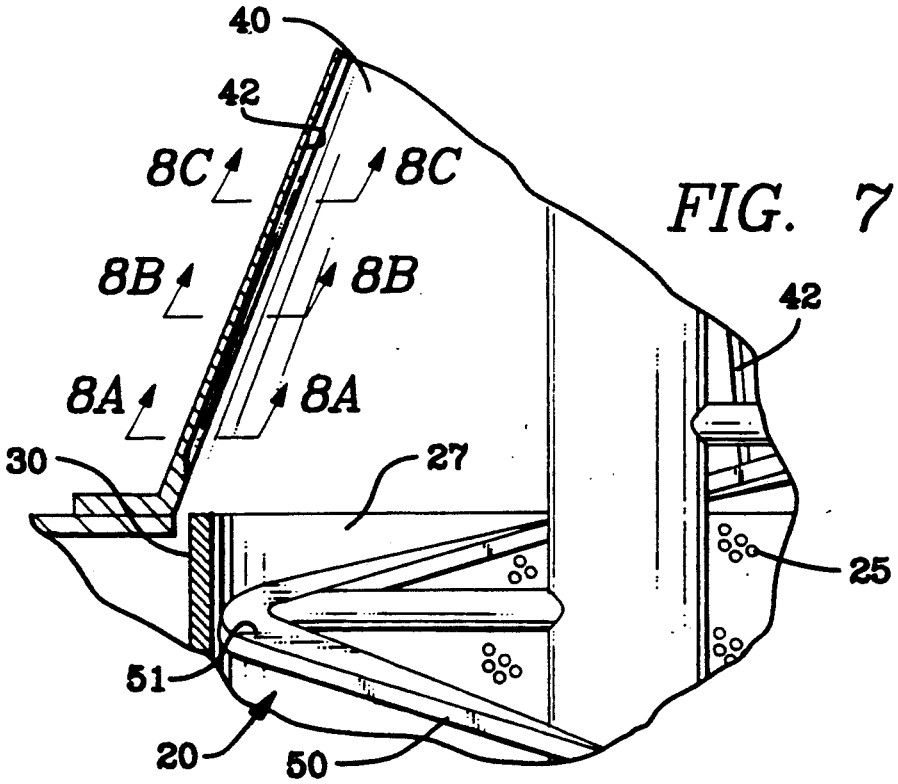
FIG. 7

METHOD AND APPARATUS FOR ENHANCING TRANSPORT OF KNOTS IN A KNOT DRAINER

BACKGROUND OF THE INVENTION

This invention relates generally to paper pulp processing machinery and more particularly to rejects drainers such as those for separating knots or other coarse particles from an acceptable pulp slurry.

Processing of wood pulp for papermaking requires removal of knots and other coarse undigested particles from the pulp slurry. This is commonly accomplished in a knot drainer, in which the pulp slurry is passed through a screen upon which the knots are retained. The knots are scraped or otherwise removed from the screen and discharged from the drainer.

Knot drainers consist usually of either high speed horizontal vibratory generally flat surfaced screens or screw type drainers. The screw type drainers may be either stationary cylindrical screen type or rotary screen type machines, which may have either horizontal or vertical axes of rotation, although the vertical axis is more commonly used today. One such rotary screen type drainer is described in a pending U.S. patent application having Ser. No. 610,696, filed Nov. 8, 1990, now U.S. Pat. No. 5,143,220 and commonly assigned herewith. In the latter case the screen is attached to the outer edge of the knot transport screw flights and rotates with them. The knots travel up the screw flights in response to inertial forces which overcome gravity, hydrodynamic forces, and the friction between the knots and the screw flight. Acceptable fibers pass through the screen perforations so that the knots are ultimately discharged from the drainer in a relatively clean condition. The rotary screen screw type knot drainer provides the advantage of eliminating relative motion between the screw flight and the screen. By comparison with non-rotating screen drainers, the rotating screen drainer has less wear and tear, because it eliminates collisions which would be caused by screen and screw irregularities if the screen were not rotating, and it also eliminates the knot crushing or grinding that would result from relative motion between the screw flights and the screen. Since knots are not crushed or ground, the acceptable fiber slurry, passing through the screen perforations, is not contaminated with knot dirt and ground-off wood particles detrimental to pulp and paper making quality.

Vibratory screen type knot drainers are known to require significant maintenance and repair due to fatigue and wear damage to the vibrating parts and structure. Stationary screen screw type knot drainers experience wear due to contact between irregularities of the screw and the screen as well as the crushing and grinding action already described. In addition, they also yield an increased debris content in the pulp slurry which can ultimately degrade paper quality.

Rotary screen screw type knot drainers experience lower incidence of fatigue damage, lower wear damage as a result of virtual elimination of crushing and grinding action, and, thus, last longer and produce cleaner pulp. One such vertical axis knot drainer has a tangential feed slurry inlet chamber at the bottom, a rotatable screw flight extending generally from the inlet chamber upward to the knot discharge chamber, a rotatable screen basket attached to the lower portion of the rotatable screw flight to define a screening chamber, and a knot washing and liquid separating stationary housing extension communicating between the screening chamber and the knot discharge chamber and encasing the upper extension of the rotatable screw flight.

Simply stated, in this knot drainer, the knot containing pulp slurry is introduced through the tangential inlet into the inlet chamber and flows spirally upward into the screening chamber. The screw conveyor flight transports the knots contained in the pulp slurry through the screening chamber in which the acceptable pulp fibers pass through the perforations in the rotating screen. Above the screening chamber, the screw conveyor flight continues to transport the knots through the fiber wash-off zone and liquid separation and drain-off zone of the stationary housing extension to the knot discharge chamber. The tangential feed is desirable because it promotes centrifugal separation of stones and other heavy "junk" materials that may be included in the feed pulp slurry so that they may be accumulated for ultimate discharge from the knot drainer through a special outlet.

The vertical axis rotary cylindrical screen type knot drainer just described is, however, subject to knot transport interruptions which necessitate shutdowns to clean out the system. It has been determined that, independent of the operating speed of the knot drainer, the pulp consistency, and geometric relationships within the knot drainer, unacceptable knot transport interruptions, with subsequent knot accumulation, occur both in the screening chamber and in the housing extension. These interruptions result in knot accumulation on the screw flights which creates serious dynamic imbalance, can seriously impact the production capacity through the knot drainer unit, and may, thus, require costly maintenance, production downtime and expensive duplication of equipment to maintain production flow during shutdown necessitated by knot transport interruptions.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing, in a device for separating coarse particles from a liquid borne slurry, and having an inlet chamber, a feed chamber, a screening chamber, a helical conveyor flight, through a wash and liquid separation chamber, and a liquid free coarse particle discharge chamber, the improvement, in combination with that device, comprising means for altering a dynamic force balance which acts upon the coarse particles during their transport through said device from the inlet chamber, through the feed chamber, through the screening chamber, and through the wash and liquid separation chamber to the discharge chamber.

The foregoing and other aspects will become apparent from the following detailed description of the invention when considered in conjunction with the accompanying drawing figures.

BRIEF DESCRIPTION OF THE DRAWINGS

FIG. 5 is a view from line 5—5 of FIG. 4 showing the preferred embodiment of that transport enhancement feature;

FIG. 6 is a view from line 6—6 of FIG. 4 showing an alternative embodiment of that transport enhancement feature;

FIG. 7 is a fragmentary schematic view of the stationary housing extension above the screening chamber illustrating the transport enhancement feature in that region of the knot drainer.

DETAILED DESCRIPTION

Figure 1:
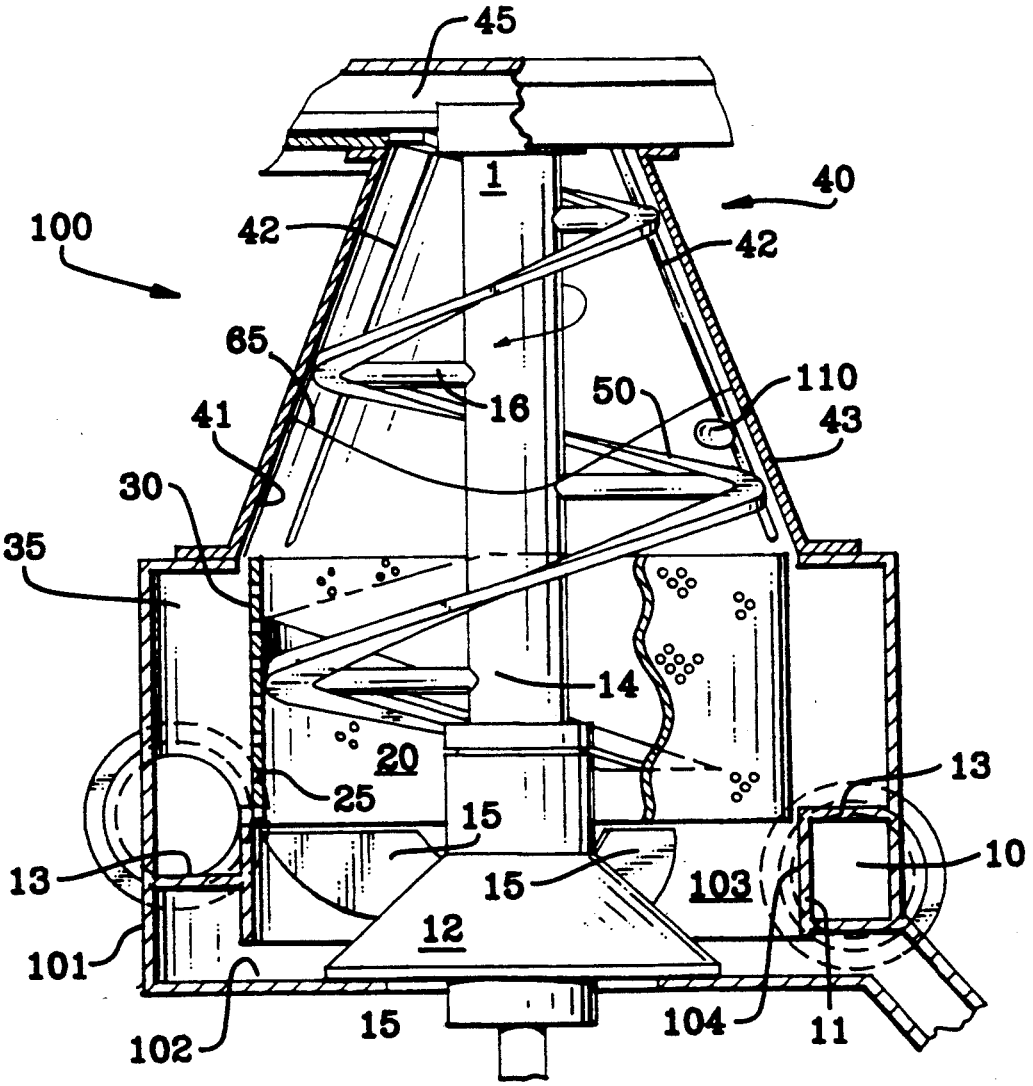
FIG. 1 is a partially sectional fragmentary schematic view showing the overall configuration of a vertical axis cylindrical screen screw type rotary knot drainer incorporating the present invention.

FIG. 1 presents an overall representation of a rotary screen screw type knot drainer 100. A knot bearing slurry is fed through the tangentially oriented inlet into inlet chamber 10 which is bounded on the top by downward spiralling plate 13 which defines the bottom of accepts chamber 35, radially outward from the screening chamber 20. The inner wall 11 of inlet chamber 10 is elevated slightly above the bottom 102 of the knot drainer housing 101 to provide a communicating path from the inlet chamber 10 through feed chamber 103, defined by surface 104 of wall 11 and bearing housing 12, to the screening chamber 20. Baffles 15 are mounted on or around rotor bearing housing 12 and project outwardly toward surface 104 of wall 11 through feed chamber 103 and also upwardly to or into screening chamber 20. Screening chamber 20 is defined by screen member or screen 30 which in this example is a right circular cylinder having a pattern of perforations 25 for selectively permitting passage of pulp slurry from screening chamber 20 through perforations 25 into accepts chamber 35 while retaining knots and other coarse particles. Screw conveyor flight 50 is supported by bracket arms 16 on rotor shaft 14. Screen 30 is joined to the outer edge of screw conveyor flight 50 s that the flight 50 and the screen 30 rotate together. Flight 50 is shown extending through about the upper three-fourths of the vertical height of screen chamber 20. Preferably, it may extend along one-half to three-fourths of the height of screen 30, although for certain applications, it will be continuous throughout the entire vertical height of screening chamber 20. In some cases it may only extend slightly into the topmost portion of the screening chamber. Above screening chamber 20, stationary housing extension 40 connects to liquid free knot discharge chamber 45. Flight 50 also extends to the knot discharge chamber 45 and rotates with its outer edge in close proximity to the inner surface 41 of stationary housing extension wall 43. On screen 30 in screening chamber 20, the pattern of perforations 25, open for the passage of pulp slurry from screening chamber 20 into accepts chamber 35, is configured to provide an imperforate surface 27 adjacent to and above the upper surface 51 of the flight 50 through which pulp slurry cannot flow from screening chamber 20 into accepts chamber 35, thus providing, in combination with the upper surface 51 of flight 50 two sides of a zone into and through which knots can be transported without being impeded or subjected to interrupted transport by drag forces and knot holding ability of the perforation entrances, a zone 55 of relatively increased tangential velocity and zero hydrodynamic screening forces on the knots. In addition, substantially vertical grooves 42 in the inner surface 41 of stationary housing extension wall 43 are shown. These grooves intermittently retard the rotary knot velocity. The knot transport enhancement features illustrated, thus, consist of baffles 15, surface 27 of zone 55 and vertical grooves 42 in housing extension 40 which, in combination, function to provide mechanisms to preclude interruptions in the passage of knots between the screening chamber 20 and knot discharge chamber 45.

The knot containing pulp slurry enters the knot drainer with a tangential velocity imparted to it by the tangential orientation of the inlet and the circular path of the inlet chamber 10. This motion is shown in the preferred embodiment as being in the same direction as the motion of screw conveyor flight 50 and screen 30 and, although consuming less power, if maintained into screening chamber 20, induces a lower relative (tangential) velocity between the screen 30 and the pulp slurry and knots. Drag generated by rotation of screen 30 also leads to a lower relative (tangential) velocity differential between screen 30 and the knot containing pulp slurry. The vertically projected surface 51 of flight 50 also tends to effect a lower relative (tangential) velocity between screen 30 and the pulp slurry and knots. In order for knots to be transported upward on flight 50 to knot discharge chamber 45, they must have a lower absolute tangential velocity than that of flight 50, i.e., have a relative velocity counter to that of flight 50. This will make possible the upward axial uninterrupted transport of the knots by transporting surface 51 into the top knot discharge chamber 45.

Figure 2:
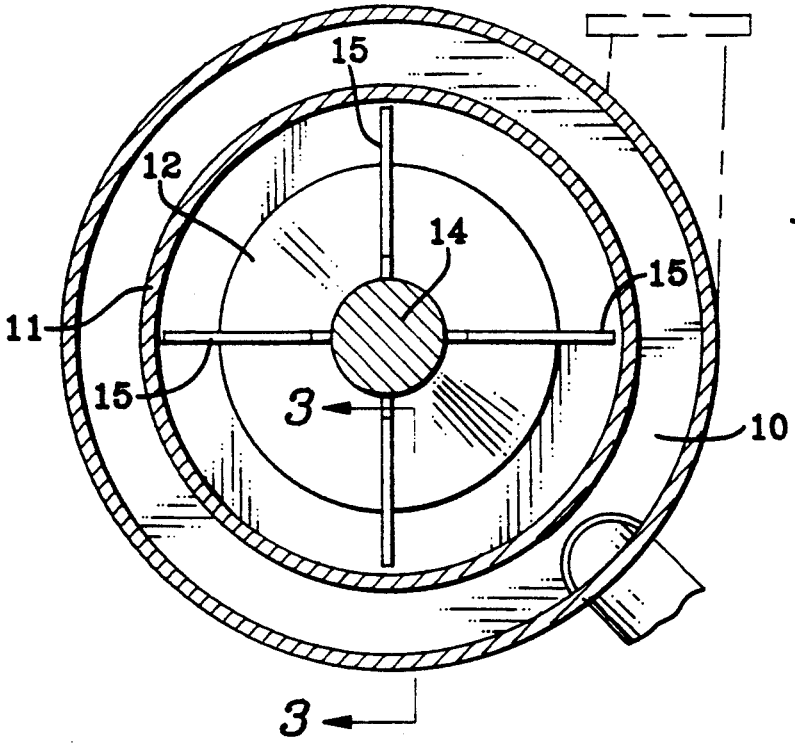
FIG. 2 is a fragmentary schematic plan view showing the vortex reducing baffle feature of the present invention.
Figure 3A:
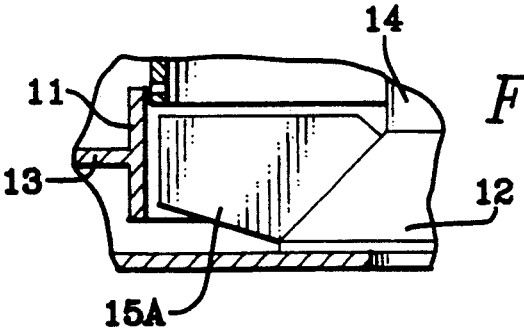
FIGS. 3A and 3B are fragmentary elevation views from line 3—3 of FIG. 2 showing possible alternative vortex reducing baffle configurations.
Figure 3B:
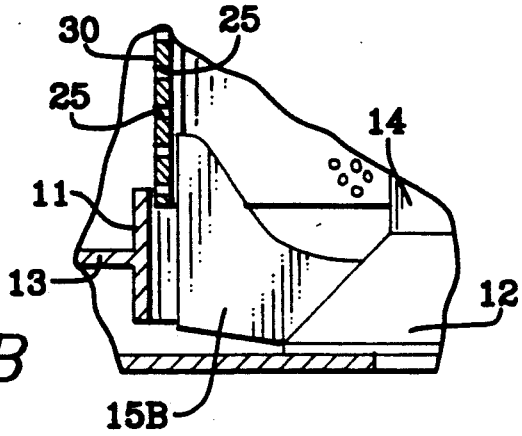

At different locations within the knot drainer, the knots are subjected to actions of differing forces. Starting from inlet chamber 10 the knots have a tangential velocity due to the orientation of the feed inlet. After passing under wall 11 and having lost substantially all of their tangential velocity due to the retarding effect of baffles 15 in feed chamber 103, the knots, being carried by the surrounding slurry, flow vertically upward into screening chamber 20. These baffles, shown in the preferred embodiment as being attached to bearing housing 12, are illustrated in more detail in FIGS. 2, 3A, and 3B. Note that FIG. 2 shows four baffles, but this is only an illustrative representation. The actual number of baffles 15 will be determined by consideration of size of the drainer 100, feed rate of the knot bearing slurry, consistency of the feed slurry, flocculating characteristic of the pulp, rotary velocity of the flight 50 and screen basket 30, number of screw flights 50, and pitch of screw flights 50. Thus, depending upon these considerations, the number, vertical height, and shape of the baffles 1 will be selected accordingly as necessary to arrest and/or retard the absolute tangential (rotary) velocity of the knot bearing pulp slurry in screening chamber 20.

Figure 4:
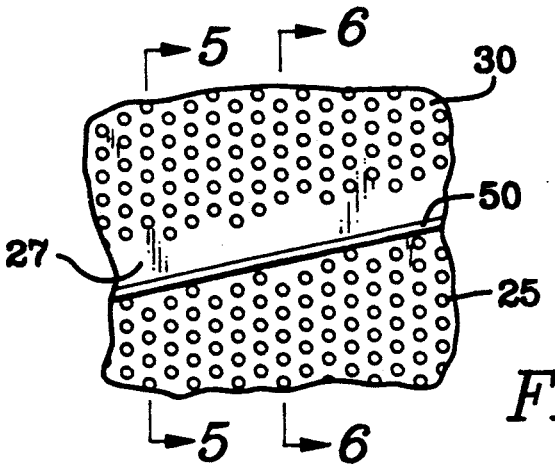
FIG. 4 is a fragmentary schematic elevation view of a portion of the screen basket illustrating part of the transport enhancement feature in that region of the knot drainer.

Within screening chamber 20, it has been found that knot transport interruptions are attributable to flow of the fine fiber slurry through perforations 25 of screen 30, which flow tends to entrain knots, pull them tightly against, and hold them firmly on screen 30. Once knots are held stationary on screen 30 draining of pulp occurs around the knots with resultant packing of pulp fibers in the voids between knots, the whole culminating in a densely centrifuged relatively dry mass firmly held on to the surface of screen 30 which produces severe vibration and/or the screen 30 becomes unable to handle the feed flow which overflows into knot collection chamber 45 and the drainer must be shut down and the packed mass dug out. This holding and knot transport interruption tendency peaks adjacent to the upper (leading) surface 51 at the point of attachment of flight 50 to screen basket 30 if perforations 25 extend to the upper surface 51 of flight 50. This is amplified by and due to induced centrifugal force on the pulp slurry and knot mixture by flight 50 and is reinforced by the centrifugal action on the knots imparted by any tangential velocity which has not been dissipated by baffles 15. (Note that, adjacent to the perforated surface of screen 30 outside of imperforate area 27, some undesirable rotary flow velocity will be induced in the knot bearing pulp slurry due to the viscous drag exerted by the rotating screen 30, knot transporting flight 50, rotor shaft 14, and flight support bracket arms 16.) However, the induced rotary velocity of the knot containing pulp slurry, which will increase in magnitude with distance traveled up screen 30, must be relatively lower than that of the inside surface of screen 30. This difference in velocity causes knots to be tangentially "dragged" over perforations 25 in screen 30 on to surface 27 and into zone 55. The relatively lower velocity of the "dragged" knots with respect to the upper transporting surface 51 of flight 50 results in the upward transport of the knots by the spiral transporting upper surface 51 of flight 50 through the unimpeded free flow channel zone 55 in screening chamber 20 and into stationary housing extension 40. FIGS. 4, 5, and 6 illustrate the feature of the invention designed to eliminate the trapping and holding effect of the hydrodynamic screening forces which would otherwise result in knot transport interruptions in the screening chamber 20.

FIG. 4 shows a fragmentary schematic representation of the screen basket 30, its pattern of perforations 25, and surface 27 being one side of a zone 55 of reduced hydrodynamic screening forces. This is described as a locus defining a knot collecting and transporting zone, and because it indicates physical occlusion of certain of the perforations 25 of screen 30 in a pattern that conforms to the shape of spiralling upper surface 51 of screw conveyor flight 50. FIG. 5 shows the preferred embodiment of zone 55 which structurally consists of an unperforated band 27 of screen 30 extending upward from the attachment point of screw flight 50. This embodiment is preferred because it also saves the time and expense of drilling perforations 25 in the area of the unperforated band 27.

FIG. 6 shows an alternative embodiment which, for example, occludes existing drilled perforations 25, which permits retrofit of existing knot drainers, and/or replacement of screw flight 50, and modification of pitch of screw flight 50. In these cases, zone 55 is bounded by surface 27*a* of insert flange 52, a very thin band which extends upwardly from the attachment point of flight 50 along the surface of screen 30 to occlude a band of perforations 25 bounding zone 55. With the embodiments shown in FIGS. 5 and 6, knots being transported upward on flight 50 move smoothly along because, while on flight 50, they are no longer subject to the holding by hydrodynamic forces and drained fiber bonding attendant upon the flow of pulp slurry and/or liquid through the perforations 25 of screen 30 otherwise normally immediately adjacent to the transporting surface of flight 50. Thus, either unperforated band 27 or flange 52 can free the knots in the screening chamber 20 from the hydrodynamic forces which would otherwise trap and hold the knots at the juncture of the upper surface 51 of flight 50 and perforations 25 of screen 30.

Above screen chamber 20, spiral screw conveyor flight 50 extends through stationary housing extension 40. Flight 50 has no outside edge flange in this portion of the knot drainer. Housing extension 40 has one or more substantially vertical grooves 42 on its inner wall. These grooves 42 improve and have been found necessary to obtain uninterrupted vertical transport of the knots through the housing extension 40 and to avoid knot build-up, accumulation, and cessation of knot transport.

When travelling through housing extension 40 the knots or coarse particles are acted upon by gravity, the motion of the screw flight, friction with the housing extension wall, viscous drag of the liquid below liquid surface 65, and drain back of liquid above liquid surface 65. If the inner wall of housing extension 40 is smooth, or becomes smooth through wear, the circumferential friction forces between the coarse particles and the inner surface 41 of housing extension wall 43 will be of lower magnitude than the combination of gravity, knot frictional forces against the upper surface 51 of screw flight 50, viscous liquid drag, and liquid drain back above liquid surface 65. This will result in the coarse particles or knots remaining stationary with respect to the transporting surface 51 of screw flight 50 thereby sliding circumferentially around housing extension 40 at a constant elevation. Knot transport will thus cease and be interrupted, resulting in continued knot build-up with resulting out of balance vibration forces, screen perforation blockage, and interruption of production.

Even below liquid surface 65, before liquid drain back forces are present, the knots are subject to the viscous swirling action of the liquid which, coupled with the frictional forces between the knots and the screw conveyor flight 50, are sufficient to overcome the circumferential frictional forces between the knots and a smooth walled stationary housing extension 40. This also favors interruption of the knot transport on the screw conveyor flight 50.

FIG. 7 is a schematic representation of a portion of the knot drainer where the screening chamber 20 adjoins stationary housing extension 40. In this view, rotating screen, or screen basket, 30 is shown to have a pattern of perforations 25 as well as a surface 27 of occluded perforations and surface 51 of screw flight 50 generally designated as forming two sides of the zone 55 of reduced hydrodynamic screening forces. In stationary housing extension 40, two substantially vertical grooves 42 are shown as being oriented axially with the screw conveyor flight 50. Under most operating conditions, this orientation is acceptable, however grooves 42 oriented perpendicular to flight 50 would be functionally optimum because the orientation of grooves 42 parallel to the normal component of the force exerted on the knots by flight 50 would present the least resistance to transport of the knots toward the discharge chamber. It should be recognized, however, that the groove 42 orientation for maximum effectiveness will depend upon groove size, geometry, and spacing, operating speed of the knot drainer, inclination or verticality of the surface 41 of housing extension wall 43, and size and surface characteristics of the knots or coarse particles being processed as well as manufacturing costs. Thus, the favored orientation of grooves 42 will be determined by the totality of factors enumerated and, in one preferred embodiment of this invention four equally spaced axially oriented grooves have been found sufficient to enhance transport of both softwood and hardwood knots and to improve liquid/knot separation.

Figure 8A:
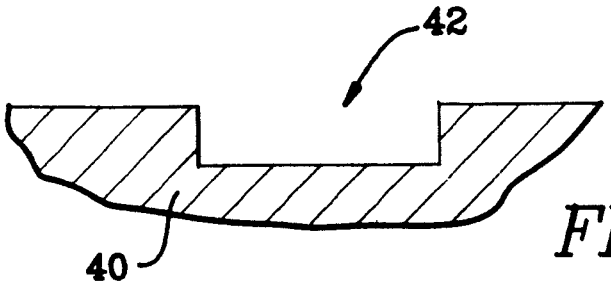
FIGS. 8A, 8B, and 8C are views from lines 8A—8A, 8B—8B, and 8C—8C, respectively, of FIG. 7 to illustrate three possible groove type cross-sectional configurations.
Figure 8B:
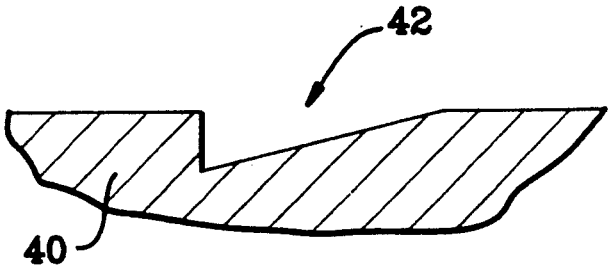
Figure 8C:
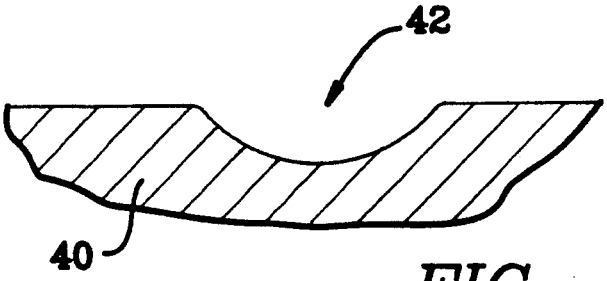

FIGS. 8A, 8B, and 8C are local cross sectional views as would be seen from reference lines 8A—8A, 8B—8B, and 8C—8C of FIG. 7 to illustrate three possible cross sectional configurations of grooves 42 in wall 43 of housing extension 40. FIG. 8C shows the preferred embodiment which allows for the smoothest continuous transport and the least opportunity for knot chipping and cutting or grinding action with flight 50. Only one cross sectional configuration of groove is used in any application and the three reference lines in FIG. 7 are used only for the sake of brevity.

In the operation of a rotary screen screw type knot drainer 100, knots are entrained in and carried by the flowing pulp/liquid mixture, and knot concentration reaches a peak at the exit of screening chamber 20. The force generated on the knots by fiber/liquid flowing through perforations 25 plus the centrifugal force on the knots combined with the knot holding tendency of the openings of perforations 25 all tend to reduce the desirable knot "sliding" on the perforated surface of screen 30 and hence negatively impact knot transport. Therefore, knot transport in screening chamber 20 is enhanced first by interposing baffles 15 in feed chamber 103 between inlet chamber 10 and transporting flights 50 in screening chamber 20. These baffles retard flow rate and reduce the tangential velocity of the feed slurry of knots, coarse particles, and fiber/liquid mixture. This reduces the magnitude of centrifugal force of the knots against screen 30 and increases the tangential velocity lag of the knots relative to the inner surface of screen basket 30, thus maximizing the speed at which the knots relatively "slide" circumferentially around the screen basket surface into the transport zone 55 on flight 50. Next, as the knot containing slurry passes through screening chamber 20, it encounters screw conveyor flight 50 which, because of its pitch and its relatively high rotary speed, lifts the knots upward along the surface 27 of screen 30 while simultaneously causing a gradual increase in the rotary velocity of the knot bearing slurry thereby creating a liquid vortex having an upper surface 65. Thus, between the bottom and the top of screening chamber 20, there is a gradient in rotary velocity of the pulp slurry and a corresponding gradient in the centrifugal force experienced by the pulp fibers and knots within the slurry. This centrifugal force tends to increase the flow rate of acceptable fibers through the perforations 25 of rotating screen basket 30. This same centrifugal force, however, increases the frictional arresting force between the knots or coarse particles and the edges of perforations 25 in the wall of screen 30. In addition, the hydrodynamic forces generated by the radially outward travel of fiber bearing liquid through perforations 25 of screen 30 tend to trap knots along with a quantity of fibers pinned between the knots and against the screen member 30. By occluding the perforations 25 along conveyor 50, in a path defining the zone 55 of reduced hydrodynamic screening forces, the effective frictional forces and holding tendency between the knots and the wall of screen 30, are eliminated, and concentrated knot transport is thus enhanced through screening chamber 20. Most of the acceptable fiber passes through the perforations 25 of screen basket 30, and, as a consequence, when the knots enter housing extension 40, they are relatively fiber free. Washing by nozzle 110 releases the remaining fiber from the knots, and the wash liquid and released fiber flow down the vortex for discharge through perforations 25.

The viscous drag exerted by the relatively fiber free liquid on the knots is significantly lower than that exerted by the pulp slurry at the inlet. The uninterrupted knot transport between the screen 30 and wash liquid separating housing extension 40 is accomplished and continued through the housing extension 40 by the significant knot circumferential arresting force attributable to the substantially vertical grooves 42 in the wall 43 of housing extension 40, which is sufficient to maintain the motion of and, depending upon the groove cross sectional configuration and angle, accelerate the knots and coarse particles up conveyor flight 50 and into liquid free knot discharge chamber 45.

As in any case where reactions are initiated, accelerated, retarded, or stopped by a change in balance between opposing forces, it should be remembered that increasing forces on one side of the balance is equivalent to decreasing forces on the other side, and vice versa. Substantially vertical grooves could also be replaced by ridges or a combination of grooves and ridges to cause the same increase in the circumferential friction component; however, such ridges would promote grinding and binding of knots and be detrimental to the performance of the drainer and the quality of accepted knot free pulp. Thus, it will be obvious to any person skilled in the art that the perturbations in force balances discussed herein represent only one example of numerous methods for accomplishing the same result.

What is claimed is:

1. In a device for separating coarse particles from a liquid borne slurry, said device having a helical conveyor flight, an inlet chamber, a feed chamber, a screening chamber, a wash and liquid separation chamber, and a liquid free coarse particle discharge chamber, the improvement in combination with said device, comprising:

means for altering dynamic balances of forces which act upon the coarse particles during their transport through said device from the inlet chamber, through the feed chamber, through said screening chamber, and through said wash and liquid separation chamber.

2. The apparatus of claim 1, wherein the means for altering dynamic balances of forces in said feed chamber comprises baffle means in said feed chamber for reducing tangential flow velocity to limit centrifugal action of said liquid borne slurry against a screen member.

3. The apparatus of claim 1, wherein the means for altering dynamic balances of forces in said screening chamber comprises a thin flange means adjacent at least a portion of the outer edge of the helical flight against a screen member for locally occluding perforations of said screen member to reduce entrainment forces due to liquid flow therethrough.

4. The apparatus of claim 1, wherein the means for altering a dynamic balance of forces in said liquid separation chamber comprises means for increasing circumferential friction force components relative to axial friction force components between the coarse particles and a wall surface of said wash and liquid separation chamber.

5. The apparatus of claim 4, wherein the means for increasing circumferential friction force components relative to axial friction force components comprises one or more substantially vertical grooves in the wall surface of said wash and liquid separation chamber.

6. The apparatus of claim 1, wherein the means for altering dynamic balances of forces in said screening chamber comprises baffle means in said screening chamber for reducing tangential flow velocity to limit centrifugal action of said liquid borne slurry against a screen member.

7. The apparatus of claim 1, wherein the means for altering dynamic balances of forces in said screening chamber comprises a helical unperforated portion of a cylindrical screen member, adjacent at least a portion of the outer edge of the helical flight, for locally reducing entrainment forces due to liquid flow therethrough.

8. In a screening apparatus, for separating coarse particles from a liquid borne slurry, of the type having a vertical substantially cylindrical body with a slurry inlet at the bottom, a radially symmetrical screen member thereabove, an imperforate housing extension, above said screen member, leading to a liquid free coarse particle discharge chamber, and a rotatable helical flight for transporting said coarse particles from the screen member into and through the housing extension to the discharge chamber, the improvement in combination with said screening apparatus, comprising:

means for reducing hydrodynamic entrainment forces which result from flow of liquid through the screen member and which trap the coarse particles against said screen member.

9. The improvement in a screening apparatus of claim 8, further comprising:

means for increasing circumferential friction force components relative to axial friction force components between the coarse particles and the wall of the housing extension.

10. The improvement in a screening apparatus of claim 8, wherein the means for reducing hydrodynamic entrainment forces comprises stationary baffle means extending into the screening chamber for reducing tangential flow velocity of said liquid borne slurry and for thereby reducing slurry against said screen member.

11. The improvement in a screening apparatus of claim 8, wherein the means for reducing hydrodynamic entrainment forces comprises a thin upwardly projecting flange means on the outer edge of the helical flight against the screen member for locally occluding perforations of said screen member to prevent liquid flow therethrough.

12. The improvement in a screening apparatus of claim 9, wherein the means for increasing circumferential friction force components relative to axial friction force components between the coarse particles and the wall of the housing extension comprises a plurality of substantially vertical grooves in the wall of said housing extension.

13. The improvement in a screening apparatus of claim 8, wherein the means for reducing hydrodynamic entrainment forces comprises a helical unperforated portion of said screen member adjacent the outer edge of the helical flight which locally reduces entrainment forces due to liquid flow therethrough.

14. In a knot drainer, for separating acceptable pulp fibers from knots in a liquid borne slurry, of the type having a housing with a liquid free knot discharge chamber at its top, a screening chamber above a slurry inlet near its bottom, a housing extension connecting the screening chamber and the knot discharge chamber, and a helical flight means for transporting the knots upward from the screening chamber to the knot discharge chamber, the improvement comprising:

means for reducing hydrodynamic forces which trap knots against a screen member in the screening chamber; and means for creating a frictional imbalance within the housing extension, which imbalance enhances knot transport through said housing extension to the knot discharge chamber.

15. The improvement in a knot drainer of claim 14, wherein the means for reducing hydrodynamic forces comprises baffle means for reducing tangential flow velocity to limit centrifugal action of said liquid borne slurry against the screen member.

16. The improvement in a knot drainer of claim 14, wherein the means for reducing hydrodynamic forces comprises an upwardly projecting flange means on the outer edge of the helical flight for locally occluding perforations of the screen member.

17. The improvement in a knot drainer of claim 14, wherein the means for creating a frictional imbalance within the housing extension comprises a plurality of substantially vertical grooves in the wall of the housing extension.

18. In a knot drainer, for separating acceptable pulp fibers from knots in a liquid borne slurry, of the type having a vertical housing with a tangentially directed slurry inlet at the bottom, a rotatable screen attached to a rotatable helical flight defining a screening chamber thereabove, a stationary housing extension above said screening chamber in close proximity to an outer edge of said rotatable helical flight, and a liquid free knot discharge chamber at the top of said housing, the improvement comprising:

means for reducing hydrodynamic forces which trap knots against said rotatable screen.

19. The improvement in a knot drainer of claim 18, wherein the means for reducing hydrodynamic forces comprises baffle means for reducing tangential flow velocity to limit centrifugal action of said fluid borne slurry against the screen.

20. The improvement in a knot drainer of claim 18, wherein the means for reducing hydrodynamic forces comprises an upwardly projecting flange means on the outer edge of the helical flight for occluding perforations of the screen.

21. The improvement in a knot drainer of claim 18, wherein the means for reducing hydrodynamic forces comprises a helical zone on said rotatable screen corresponding to the attachment site of the rotatable helical flight and extending above said attachment site, said helical zone being imperforate and permitting no flow of liquid therethrough.

22. The improvement in a knot drainer of claim 18, further comprising:

means for increasing circumferential friction force components relative to axial friction force components between the knots and the housing extension wall.

23. The improvement in a knot drainer of claim 22, wherein the means for increasing circumferential friction force components relative to axial friction force components comprises a plurality of substantially vertical grooves in the wall of the housing extension.

24. A method for enhancing the transport, on a helical flight, of coarse particles separated from a liquid borne slurry of fine particulate material, comprising:

providing means for reducing hydrodynamic entrainment forces which trap coarse particles against a screen member used to separate said coarse particles from said liquid borne slurry;

transporting said separated coarse particles from said screen member on a helical flight to a liquid separation chamber having a stationary outer housing wall; and providing means for increasing circumferential friction force components relative to axial friction force components between the coarse particles and said stationary outer housing wall surrounding said helical flight.

* * * * *